US008569974B2

(12) United States Patent
Chobot

(10) Patent No.: US 8,569,974 B2
(45) Date of Patent: Oct. 29, 2013

(54) SYSTEMS AND METHODS FOR CONTROLLING SOLID STATE LIGHTING DEVICES AND LIGHTING APPARATUS INCORPORATING SUCH SYSTEMS AND/OR METHODS

(75) Inventor: Joseph Paul Chobot, Morrisville, NC (US)

(73) Assignee: Cree, Inc., Durham, NC (US)

( * ) Notice: Subject to any disclaimer, the term of this patent is extended or adjusted under 35 U.S.C. 154(b) by 241 days.

(21) Appl. No.: 12/987,485

(22) Filed: Jan. 10, 2011

(65) Prior Publication Data

US 2012/0104953 A1 May 3, 2012

Related U.S. Application Data

(60) Provisional application No. 61/408,860, filed on Nov. 1, 2010.

(51) Int. Cl.
*G05F 1/00* (2006.01)

(52) U.S. Cl.
USPC ..... 315/307; 315/308; 315/291; 315/224; 315/149; 315/312; 362/231; 362/227; 362/276

(58) Field of Classification Search
USPC ..... 315/307, 308, 291, 224, 149, 159, 312, 315/362, 169.3, 118, 360, 185 R, 192, 193; 362/234, 253, 800, 276, 227; 250/226, 250/216, 205, 214 C, 214 AL
See application file for complete search history.

(56) References Cited

U.S. PATENT DOCUMENTS

| | | | |
|---|---|---|---|
| 3,638,042 | A | 1/1972 | Studtmann |
| 3,655,988 | A | 4/1972 | Nakamura et al. |
| 3,913,098 | A | 10/1975 | Nakamura et al. |
| 5,059,788 | A | 10/1991 | Tashiro et al. |

(Continued)

FOREIGN PATENT DOCUMENTS

| | | | |
|---|---|---|---|
| EP | 1 020 935 | A2 | 7/2000 |
| JP | 59-113768 | A | 6/1984 |
| JP | 4 196359 | A | 7/1992 |

OTHER PUBLICATIONS

International Search Report Corresponding to International Application No. PCT/US11/54846; Date of Mailing: Jan. 23, 2012; 13 pages.

(Continued)

*Primary Examiner* — Haiss Philogene
(74) *Attorney, Agent, or Firm* — Myers Bigel Sibley & Sajovec, P.A.

(57) ABSTRACT

A solid state lighting apparatus includes a first plurality of light emitting devices configured to emit light when energized having a first chromaticity, a second plurality of light emitting devices configured to emit light when energized having a second chromaticity, different from the first chromaticity, and a controller configured to control a duty cycle of current supplied to the first plurality of light emitting devices. The controller is configured to control the duty cycle of the first plurality of light emitting devices in response to a change in a plurality of operating conditions of the solid state lighting apparatus in accordance with a model of the duty cycle that relates the duty cycle of the first plurality of light emitting devices to the plurality of operating conditions of the solid state lighting apparatus for a target light output characteristic of the solid state lighting apparatus. Related methods are also disclosed.

19 Claims, 7 Drawing Sheets

(56) References Cited

U.S. PATENT DOCUMENTS

| | | | | |
|---|---|---|---|---|
| 5,125,675 | A | 6/1992 | Engelbrecht | |
| 5,357,120 | A | 10/1994 | Mori | |
| 5,467,049 | A | 11/1995 | Kida et al. | |
| 5,598,068 | A | 1/1997 | Shirai | |
| 5,646,760 | A | 7/1997 | Kuijk et al. | |
| 5,798,520 | A | 8/1998 | Kuijk et al. | |
| 6,411,155 | B2 | 6/2002 | Pezzani | |
| 6,501,630 | B1 | 12/2002 | Colclaser et al. | |
| 7,109,664 | B2 | 9/2006 | Wu | |
| 7,213,940 | B1 | 5/2007 | Van De Ven et al. | |
| 7,319,298 | B2 * | 1/2008 | Jungwirth et al. | 315/307 |
| 7,427,838 | B2 | 9/2008 | Hosoya | |
| 7,439,945 | B1 | 10/2008 | Awalt et al. | |
| 7,649,326 | B2 * | 1/2010 | Johnson et al. | 315/291 |
| 7,821,194 | B2 | 10/2010 | Negley et al. | |
| 7,863,829 | B2 * | 1/2011 | Sayers et al. | 315/291 |
| 7,967,652 | B2 | 6/2011 | Emerson | |
| 8,330,383 | B2 * | 12/2012 | Man et al. | 315/247 |
| 8,342,694 | B2 * | 1/2013 | Shibasaki | 353/85 |
| 8,356,916 | B2 * | 1/2013 | Gordin et al. | 362/249.02 |
| 2001/0032985 | A1 | 10/2001 | Bhat et al. | |
| 2002/0043943 | A1 | 4/2002 | Menzer et al. | |
| 2002/0139987 | A1 | 10/2002 | Collins, III et al. | |
| 2004/0042205 | A1 | 3/2004 | Tanabe et al. | |
| 2005/0179629 | A1 | 8/2005 | Inoue | |
| 2006/0049782 | A1 | 3/2006 | Vornsand et al. | |
| 2006/0176411 | A1 | 8/2006 | Furukawa | |
| 2006/0221609 | A1 | 10/2006 | Ryan, Jr. | |
| 2006/0244396 | A1 | 11/2006 | Bucur | |
| 2007/0013620 | A1 | 1/2007 | Tanahashi et al. | |
| 2007/0115228 | A1 | 5/2007 | Roberts et al. | |
| 2007/0115662 | A1 | 5/2007 | Roberts et al. | |
| 2008/0130283 | A1 | 6/2008 | Chang | |
| 2008/0211415 | A1 | 9/2008 | Altamura | |
| 2008/0252197 | A1 | 10/2008 | Li et al. | |
| 2009/0160363 | A1 | 6/2009 | Negley et al. | |
| 2009/0184616 | A1 | 7/2009 | Van De Ven et al. | |
| 2010/0060175 | A1 | 3/2010 | Lethellier | |
| 2010/0109570 | A1 | 5/2010 | Weaver | |
| 2010/0259182 | A1 | 10/2010 | Man et al. | |
| 2010/0308738 | A1 | 12/2010 | Shteynberg et al. | |
| 2010/0308739 | A1 | 12/2010 | Shteynberg et al. | |
| 2011/0057571 | A1 * | 3/2011 | Ackermann et al. | 315/158 |
| 2011/0068696 | A1 | 3/2011 | van de Ven et al. | |
| 2011/0068702 | A1 | 3/2011 | van de Ven et al. | |

OTHER PUBLICATIONS

Notification of Transmittal of the International Search Report and the Written Opinion of the International Searching Authority, or the Declaration, International Search Report, and Written Opinion of the International Searching Authority, PCT International Application No. PCT/US2006/011820, Aug. 7, 2006.

International Search Report and Written Opinion Corresponding to International Application No. PCT/US12/69079; Date of Mailing: Feb. 28, 2013; 20 Pages.

International Preliminary Report on Patentability Corresponding to International Application No. PCT/US2011/054846; Date of Mailing: May 16, 2013; 10 Pages.

* cited by examiner

SYSTEMS AND METHODS FOR CONTROLLING SOLID STATE LIGHTING DEVICES AND LIGHTING APPARATUS INCORPORATING SUCH SYSTEMS AND/OR METHODS

CROSS-REFERENCE TO RELATED APPLICATION

The present application claims priority under 35 U.S.C. §119(e) to U.S. Provisional Patent Application Ser. No. 61/408,860, filed Nov. 1, 2010, the content of which is incorporated herein by reference as if set forth in its entirety.

FIELD OF THE INVENTION

The present invention relates to solid state lighting, and more particularly to solid state lighting systems including a plurality of solid state lighting devices and methods of operating solid state lighting systems including a plurality of solid state lighting devices.

BACKGROUND

Solid state lighting arrays are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

Solid state lighting panels are commonly used as backlights for small liquid crystal display (LCD) screens, such as LCD display screens used in portable electronic devices. In addition, there has been increased interest in the use of solid state lighting panels as backlights for larger displays, such as LCD television displays.

For smaller LCD screens, backlight assemblies typically employ white LED lighting devices that include a blue-emitting LED coated with a wavelength conversion phosphor that converts some of the blue light emitted by the LED into yellow light. The resulting light, which is a combination of blue light and yellow light, may appear white to an observer. However, while light generated by such an arrangement may appear white, objects illuminated by such light may not appear to have a natural coloring, because of the limited spectrum of the light. For example, because the light may have little energy in the red portion of the visible spectrum, red colors in an object may not be illuminated well by such light. As a result, the object may appear to have an unnatural coloring when viewed under such a light source.

Visible light may include light having many different wavelengths. The apparent color of visible light can be illustrated with reference to a two dimensional chromaticity diagram, such as the 1931 International Conference on Illumination (CIE) Chromaticity Diagram illustrated in FIG. 6, and the 1976 CIE u'v' Chromaticity Diagram, which is similar to the 1931 Diagram but is modified such that similar distances on the 1976 u'v' CIE Chromaticity Diagram represent similar perceived differences in color. These diagrams provide useful reference for defining colors as weighted sums of colors.

In a CIE-u'v' chromaticity diagram, such as the 1976 CIE Chromaticity Diagram, chromaticity values are plotted using scaled u- and v- parameters which take into account differences in human visual perception. That is, the human visual system is more responsive to certain wavelengths than others. For example, the human visual system is more responsive to green light than red light. The 1976 CIE-u'v' Chromaticity Diagram is scaled such that the mathematical distance from one chromaticity point to another chromaticity point on the diagram is proportional to the difference in color perceived by a human observer between the two chromaticity points. A chromaticity diagram in which the mathematical distance from one chromaticity point to another chromaticity point on the diagram is proportional to the difference in color perceived by a human observer between the two chromaticity points may be referred to as a perceptual chromaticity space. In contrast, in a non-perceptual chromaticity diagram, such as the 1931 CIE Chromaticity Diagram, two colors that are not distinguishably different may be located farther apart on the graph than two colors that are distinguishably different.

As shown in FIG. 6, colors on a 1931 CIE Chromaticity Diagram are defined by x and y coordinates (i.e., chromaticity coordinates, or color points) that fall within a generally U-shaped area. Colors on or near the outside of the area are saturated colors composed of light having a single wavelength, or a very small wavelength distribution. Colors on the interior of the area are unsaturated colors that are composed of a mixture of different wavelengths. White light, which can be a mixture of many different wavelengths, is generally found near the middle of the diagram, in the region labeled 100 in FIG. 6. There are many different hues of light that may be considered "white," as evidenced by the size of the region 100. For example, some "white" light, such as light generated by sodium vapor lighting devices, may appear yellowish in color, while other "white" light, such as light generated by some fluorescent lighting devices, may appear more bluish in color.

Light that generally appears green is plotted in the regions 101, 102 and 103 that are above the white region 100, while light below the white region 100 generally appears pink, purple or magenta. For example, light plotted in regions 104 and 105 of FIG. 6 generally appears magenta (i.e., red-purple or purplish red).

It is further known that a binary combination of light from two different light sources may appear to have a different color than either of the two constituent colors. The color of the combined light may depend on the relative intensities of the two light sources. For example, light emitted by a combination of a blue source and a red source may appear purple or magenta to an observer. Similarly, light emitted by a combination of a blue source and a yellow source may appear white to an observer.

Also illustrated in FIG. 6 is the planckian locus 106, which corresponds to the location of color points of light emitted by a black-body radiator that is heated to various temperatures. In particular, FIG. 6 includes temperature listings along the black-body locus. These temperature listings show the color path of light emitted by a black-body radiator that is heated to such temperatures. As a heated object becomes incandescent, it first glows reddish, then yellowish, then white, and finally bluish, as the wavelength associated with the peak radiation of the black-body radiator becomes progressively shorter with increased temperature. Illuminants which produce light which is on or near the black-body locus can thus be described in terms of their correlated color temperature (CCT).

The chromaticity of a particular light source may be referred to as the "color point" of the source. For a white light source, the chromaticity may be referred to as the "white point" of the source. As noted above, the white point of a white light source may fall along the planckian locus. Accordingly, a white point may be identified by a correlated color temperature (CCT) of the light source. White light typically has a CCT of between about 2000 K and 8000 K. White light with a CCT of 4000 may appear yellowish in color, while light with a CCT of 8000 K may appear more bluish in color. Color coordinates that lie on or near the black-body locus at a color temperature between about 2500 K and 6000 K may yield pleasing white light to a human observer.

"White" light also includes light that is near, but not directly on the planckian locus. A Macadam ellipse can be used on a 1931 CIE Chromaticity Diagram to identify color points that are so closely related that they appear the same, or substantially similar, to a human observer. A Macadam ellipse is a closed region around a center point in a two-dimensional chromaticity space, such as the 1931 CIE Chromaticity Diagram, that encompasses all points that are visually indistinguishable from the center point. A seven-step Macadam ellipse captures points that are indistinguishable to an ordinary observer within seven standard deviations, a ten step Macadam ellipse captures points that are indistinguishable to an ordinary observer within ten standard deviations, and so on. Accordingly, light having a color point that is within about a ten step Macadam ellipse of a point on the planckian locus may be considered to have the same color as the point on the planckian locus.

The ability of a light source to accurately reproduce color in illuminated objects is typically characterized using the color rendering index (CRI). In particular, CRI is a relative measurement of how the color rendering properties of an illumination system compare to those of a black-body radiator. The CRI equals 100 if the color coordinates of a set of test colors being illuminated by the illumination system are the same as the coordinates of the same test colors being irradiated by the black-body radiator. Daylight has the highest CRI (of 100), with incandescent bulbs being relatively close (about 95), and fluorescent lighting being less accurate (70-85).

For large-scale backlight and illumination applications, it is often desirable to provide a lighting source that generates a white light having a high color rendering index, so that objects and/or display screens illuminated by the lighting panel may appear more natural. Accordingly, to improve CRI, red light may be added to the white light, for example, by adding red emitting phosphor and/or red emitting devices to the apparatus. Other lighting sources may include red, green and blue light emitting devices. When red, green and blue light emitting devices are energized simultaneously, the resulting combined light may appear white, or nearly white, depending on the relative intensities of the red, green and blue sources.

One difficulty with solid state lighting systems including multiple solid state devices is that the manufacturing process for LEDs typically results in variations between individual LEDs. This variation is typically accounted for by binning, or grouping, the LEDs based on brightness, and/or color point, and selecting only LEDs having predetermined characteristics for inclusion in a solid state lighting system. LED lighting devices may utilize one bin of LEDs, or combine matched sets of LEDs from different bins, to achieve repeatable color points for the combined output of the LEDs. Even with binning, however, LED lighting systems may still experience significant variation in color point from one system to the next.

One technique to tune the color point of a lighting fixture, and thereby utilize a wider variety of LED bins, is described in commonly assigned United States Patent Publication No. 2009/0160363, the disclosure of which is incorporated herein by reference. The '363 application describes a system in which phosphor converted LEDs and red LEDs are combined to provide white light. The ratio of the various mixed colors of the LEDs is set at the time of manufacture by measuring the output of the light and then adjusting string currents to reach a desired color point. The current levels that achieve the desired color point are then fixed for the particular lighting device.

LED lighting systems employing feedback to obtain a desired color point are described in U.S. Publication No. 2007/0115662 and 2007/0115228 and the disclosures of which are incorporated herein by reference.

SUMMARY

Some embodiments provide methods of controlling a solid state lighting apparatus. The methods include providing a first model of a duty cycle of at least one light emitting device of the solid state lighting apparatus based on a temperature of the light emitting device and a level of current supplied to the light emitting device for a target chromaticity of light generated by the solid state lighting apparatus, and controlling the duty cycle of the at least one light emitting device in response to change in at least one of the temperature of the light emitting device and/or the level of current supplied to the light emitting device in accordance with the first model. An actual chromaticity of light generated by the solid state lighting apparatus is measured in response to controlling the duty cycle of the at least one light emitting device in accordance with the first model, and the measured chromaticity of light output by the solid state lighting apparatus is compared to the target chromaticity for light output by the solid state lighting apparatus. In response to a difference between the measured chromaticity and the target chromaticity, a second model of the duty cycle of the at least one light emitting device based on the temperature of the light emitting device and/or the level of current supplied to the light emitting device for an adjusted target chromaticity of light generated by the solid state lighting apparatus is provided, and the duty cycle of the at least one light emitting device is controlled in accordance with the second model.

The first model of the duty cycle of the at least one light emitting device of the solid state lighting apparatus may include a plurality of control points of a Bézier surface that relates the duty cycle of the at least one light emitting device to the temperature of the light emitting device and the level of current supplied to the light emitting device for the target chromaticity.

Methods of controlling a solid state lighting apparatus according to further embodiments include providing a first model of an operating parameter of the solid state lighting apparatus based on at least one operating condition of the solid state lighting apparatus for a target light output characteristic of the solid state lighting apparatus, controlling the operating parameter of the first plurality of light emitting devices in response to a change in the at least one operating condition in accordance with the first model, measuring the light output characteristic of the solid state lighting apparatus, and comparing the measured light output characteristic to an acceptable range of light output characteristics for the solid state lighting apparatus. In response to a difference between the measured light output characteristic and the target light output characteristic, a second model of the operating parameter of the solid state lighting apparatus based on the at least one operating condition of the solid state lighting apparatus for an adjusted target light output characteristic of the solid state lighting apparatus is provided, and the operating parameter of the first plurality of light emitting devices is controlled in response to a change in the at least one operating condition based on the second model.

In some embodiments, the operating parameter may include a duty cycle of current supplied to at least one light emitting device in the solid state lighting apparatus.

The at least one operating condition of the solid state lighting apparatus includes a temperature of the solid state lighting apparatus and/or a current supplied to at least one light emitting device in the solid state lighting apparatus.

The first model of the operating parameter of the solid state lighting apparatus may include a plurality of control points of a Bézier surface that relates the operating parameter of the solid state lighting apparatus to the at least one operating condition of the solid state lighting apparatus for the target light output characteristic.

The light output characteristic may include a chromaticity point of light output by the solid state lighting apparatus and/or an intensity of light output by the solid state lighting apparatus.

The solid state lighting apparatus may include a first plurality of light emitting devices configured to emit light having a first chromaticity when energized and a second plurality of light emitting devices configured to emit light having a second chromaticity, different from the first chromaticity, when energized, and the operating parameter may include a duty cycle of operation of the first plurality of light emitting devices.

A solid state lighting apparatus according to some embodiments includes a first light emitting device configured to emit light having a first chromaticity when energized, a second light emitting device configured to emit light having a second chromaticity, different from the first chromaticity, and a controller configured to control a current level supplied to the first light emitting device. The controller may be configured to control the current level of the first light emitting device in response to a change in an operating condition of the solid state lighting apparatus in accordance with a model of the current level that relates the current level of the first light emitting device to the operating condition of the solid state lighting apparatus for a target light output characteristic of the solid state lighting apparatus.

The operating condition of the solid state lighting apparatus may include a temperature of the solid state lighting apparatus and/or a current supplied to at least one light emitting device in the solid state lighting apparatus.

The model of the current level of the first light emitting device may include one or more control points of a Bézier surface that relates the current level of the first light emitting device to the operating condition of the solid state lighting apparatus for the target light output characteristic.

In some embodiments, the first light emitting device and the second light emitting device may be connected in a series string, and the apparatus may further include a bypass circuit configured to selectively bypass the first light emitting device and a controller coupled to the bypass circuit and configured to control operation of the bypass circuit.

In other embodiments, the first light emitting device may be connected in series to a first current source and the second light emitting device may be connected in series to a second current source, and the apparatus may further include a controller coupled to the first current source and configured to selectively activate and deactivate the first current source in accordance with the current level of the first light emitting device.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Embodiments of the present invention provide systems and methods for controlling solid state lighting devices and lighting apparatus incorporating such systems and/or methods. In some embodiments, the present invention can be utilized in connection with bypass compensation circuits as described in co-pending and commonly assigned U.S. patent application Ser. No. 12/566,195 entitled "Solid State Lighting Apparatus with Controllable Bypass Circuits and Methods of Operating Thereof" and co-pending and commonly assigned U.S. patent application Ser. No. 12/566,142 entitled "Solid State Lighting Apparatus with Configurable Shunts", the disclosures of which are incorporated herein by reference.

The bypass compensation circuits may switch between LED(s), variably shunt around LED(s) and/or bypass LED(s) in a solid state lighting system or apparatus. According to some embodiments, the output of the lighting apparatus is modeled based on one or more variables, such as current, temperature and/or LED bins (brightness and/or color bins) used, and the level of bypass/shunting employed. The model may be adjusted for variations in individual lighting devices.

Figure 1:
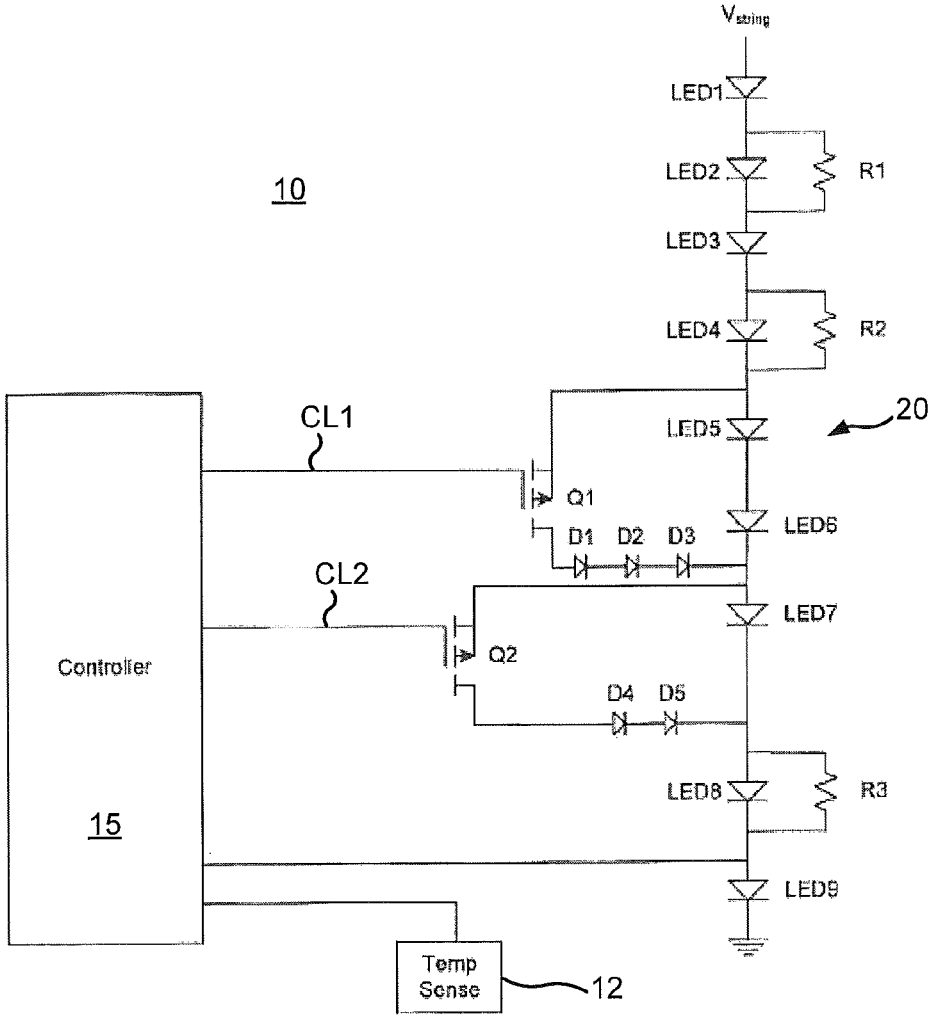
FIG. 1 is a schematic circuit diagram of portions of a solid state light emitting apparatus according to some embodiments.

Embodiments of the invention are illustrated in FIGS. 1 to 5. FIG. 1 is a schematic diagram illustrating some aspects of a solid state lighting (SSL) apparatus 10 according to the present invention. As seen in FIG. 1, the SSL apparatus 10 includes a string 20 of LEDs (LED 1 through LED9) connected in series between a voltage source Vstring and ground. A controller 15 is coupled to the string 20 and to control gates of transistors Q1 and Q2 via control lines CL1 and CL2. A temperature sensor 12 provides temperature sense information to the controller 15.

The string 20 may include LEDs that emit different colors of light when current is passed through the string. For example, some of the LEDs may include phosphor coated LEDs that emit broad spectrum white, or near-white light when energized. Some of the LEDs may be configured to emit blue shifted yellow (BSY) light as disclosed, for example, in commonly assigned U.S. Pat. No. 7,213,940 issued May 8, 2007, entitled "Lighting Device And Lighting Method", and/or blue-shifted red (BSR) light as disclosed in U.S. application Ser. No. 12/425,855, filed Apr. 19, 2009, entitled "Methods for Combining Light Emitting Devices in a Package and Packages Including Combined Light Emitting Devices", or U.S. Pat. No. 7,821,194, issued Oct. 26, 2010, entitled "Solid State Lighting Devices Including Light Mixtures" the disclosures of which are incorporated herein by reference. Others of the LEDs may emit saturated or near-saturated narrow spectrum light, such as blue, green, amber, yellow or red light when energized. In further embodiments, the LEDs may be BSY, red and blue LEDs as described in co-pending and commonly assigned U.S. Patent Application Publication No. 2009/0184616, the disclosure of which is incorporated herein by reference, phosphor converted white or other combinations of LEDs, such as red-green-blue (RGB) and/or red-green-blue-white (RGBW) combinations.

In one example, LEDS and LED6 may be red LEDs and LED7 may be a blue LED. The remaining LEDs may be BSY and/or red LEDs.

The string 20 of LEDs includes subsets of LEDs that may be selectively bypassed by activation of transistors Q1 and Q2. For example, when transistor Q1 is switched on, LEDS and LED6 are bypassed, and non-light emitting diodes D1, D2 and D3 are switched into the string 20. Similarly, when transistor Q2 is switched on, LED7 is bypassed, and non-light emitting diodes D4 and D5 are switched into the string 20. Non-light emitting Diodes D1 through D5 are included so that variations in the overall string voltage are reduced when LEDS, LED6 and LED7 are switched out of the string by transistors Q1 and Q2, The controller 15 controls the duty cycles of the transistors Q1 and Q2 via control signals on control lines CL1 and CL2 based on control models loaded in the controller 15, as described in more detail below. In particular, the duty cycles of the transistors Q1 and Q2 may be controlled in response to a model that is based on factors, such as a temperature sensor measurement provided by the temperature sensor 12 and/or a measurement of current in the string 20, for example, as reflected by variations in voltage across LED9 (reference U.S. application Ser. No. 12/968,789, entitled "LIGHTING APPARATUS USING A NON-LINEAR CURRENT SENSOR AND METHODS OF OPERATION THEREOF" filed Dec. 15, 2010. The model may also be based on factors, such as the brightness and/or chromaticity bins of the LEDs (LED1-LED9). The duty cycles of the transistors Q1 and Q2 may be controlled so that the total combined light output by the string 20 has a desired chromaticity, or color point.

In some embodiments, the controller 15 may be a suitably configured programmable microcontroller, such as a Atmel ATtiny10 microcontroller. As will be discussed in more detail below, the model may use a Bezier surface that is defined based on a plurality of control points to select a duty cycle for the red or blue LEDs in response to detected temperature and current through the string 20.

Figure 2:
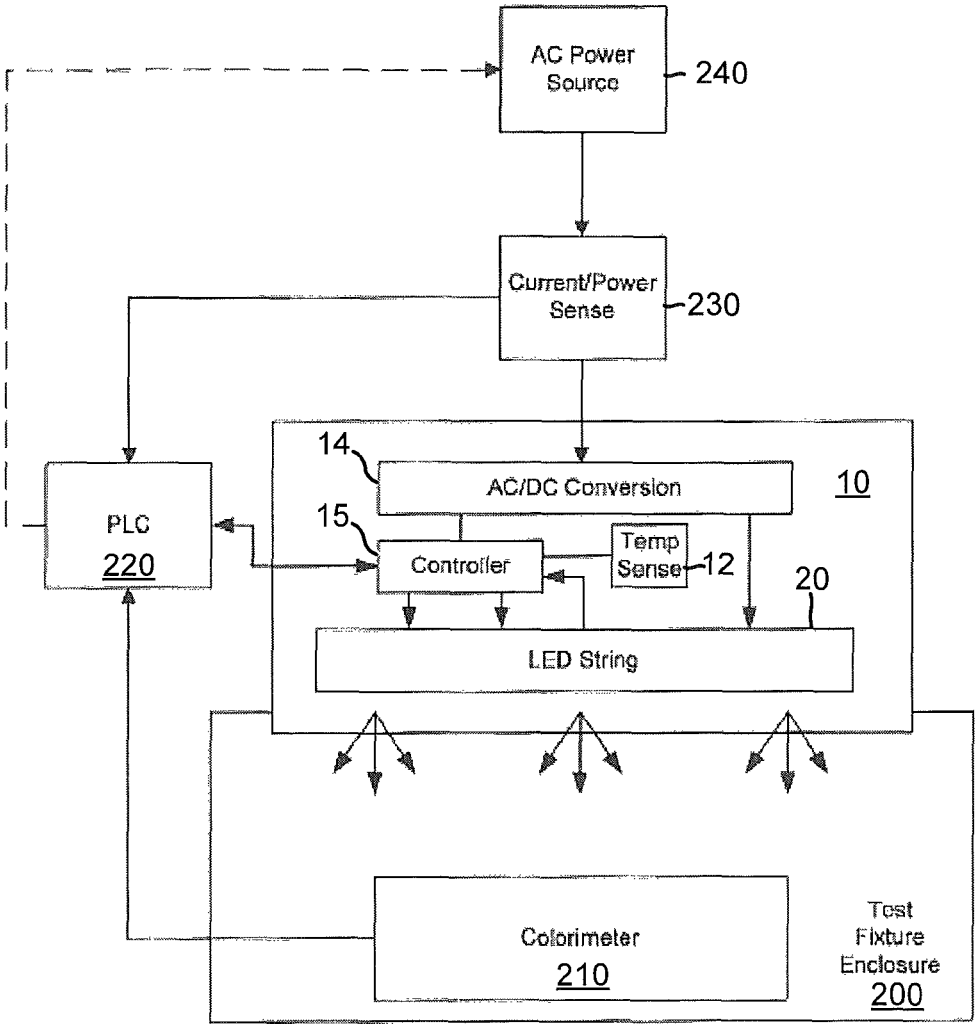
FIG. 2 is a block diagram of a calibration system for a solid state light emitting apparatus according to some embodiments.

A model for controlling operations of the SSL apparatus 10 may be generated by calibrating the SSL apparatus 10 using a calibration system, such as the calibration system illustrated in FIG. 2. As seen in FIG. 2, an SSL apparatus 10 including one or more strings 20 of LEDs may be coupled to a test fixture enclosure 200 including a colorimeter 210 that is configured to receive and analyze light emitted by the LED string 20. The colorimeter 210 may be, for example, a PR-650 SpectraScan® Colorimeter from Photo Research Inc., which can be used to make direct measurements of luminance, CIE Chromaticity (1931 xy and 1976 u'v') and/or correlated color temperature.

The output of the colorimeter 210 is provided to a programmable logic controller (PLC) 220. The PLC 220 also receives a measurement of current supplied to the LED string 20. The current measurement may be provided, for example, by a current/power sense module 230 that is coupled to an AC power source 240 that powers the SSL apparatus 10. In other embodiments, the controller 15 may sense current in the LED string 20 and provide the current measurement to the PLC 220.

As further illustrated in FIG. 2, the LED string 20 may be powered by an AC to DC converter 14, either directly or through the controller 15. The controller 15 controls light output by the LEDs by controlling the current level and/or duty cycle of the LEDs in the LED string 20. The PLC 220 may load the controller 15 with control points from which the duty cycle can be calculated in response to the current and/or temperature measurements in the manner described in detail below.

While various functions of the system of FIG. 2 are illustrated as part of the SSL apparatus 10 or the test fixture 200, these functions may be moved between the devices as needed. For example, if the AC/DC conversion is provided as a separate module, the conversion function may be provided as part of the test fixture 200 and the SSL apparatus, or a module or subcomponent of the SSL apparatus 10 may be provided with the controller 15 and LEDs.

Figure 3:
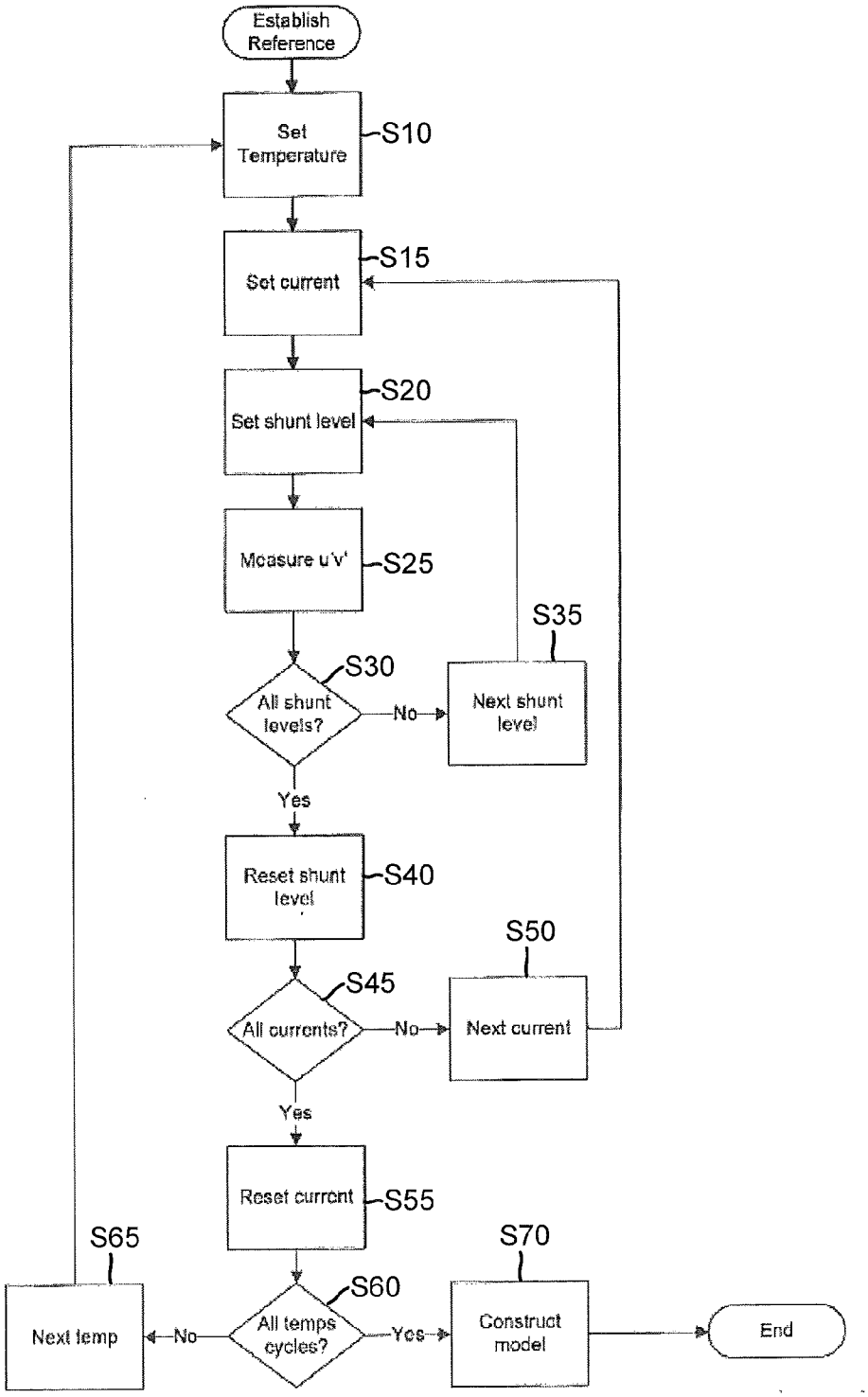
FIG. 3 is a flowchart illustrating calibration systems/methods for a solid state light emitting apparatus according to some embodiments.

FIG. 3 is a flowchart illustrating operations of a system for developing reference models for use in tuning an SSL apparatus 10 according to some embodiments. In the operations illustrated in FIG. 3, a model SSL apparatus 10, or a reference set of LEDs including an LED controller such as would be included in an SSL apparatus 10, is evaluated to develop models for subsequent tuning of solid state lighting devices using the same combinations of LEDs and controller as in the reference set. The reference set may include, for example, BSY LEDs from two different color and/or brightness bins, one or more blue LEDs from one or more color and/or brightness bins and one or more red LEDs from one or more color and/or brightness bins. The particular combinations of LEDs of the reference set of LEDs is selected based on a desired combination in manufacturing the SSL devices with a unique reference set being provided for each combination to be used in manufacturing.

To develop an accurate model for the SSL apparatus 10, the reference set of LEDs is energized under a variety of conditions, and the color and/or intensity of light output of the reference set of LEDs is measured and characterized under these conditions. The conditions to be varied are to be similar to conditions that are expected to be encountered in operation of the solid state lighting device.

In some embodiments, the conditions that are varied are current level, temperature and shunt level for shunting around particular LEDs to control color point (e.g., duty cycle of a pulse width modulated control signal). In other systems, more or fewer conditions may need to be varied. For example, if the SSL device is intended for use in a temperature controlled environment, then varying the temperature need not be performed and the evaluation carried out at the temperature of the controlled environment.

When the light output characteristics for all the shunt levels have been measured and stored, then next current level is set and the shunt level again varied and the light output measured and stored. This process is repeated until measurements are obtained over the entire or a portion of the operating range for the current. When measurements have been taken and stored for the desired range of currents, the temperature of the reference set of LEDs is adjusted to a new temperature and the measurement process repeated. This measurement process is repeated for the temperatures within the operating range of the SSL device. In particular the temperature may be the temperature of a test point of the LEDs and may be measured directly or through a controller for the reference set of LEDs.

As seen in FIG. 3, the evaluation of the reference set of LEDs is carried out by setting the temperature, setting the current and setting the shunt level for a group of controlled LEDs, and then measuring the light output of the reference set of LEDs at the settings. The light output can be measured for color point (e.g., the (u',v') coordinates in a 1976 CIE chromaticity space) and/or lumen output. These measurements may be stored, and the shunt level may be varied across the entire range of operation for the control circuit with a measurement of the light output taken at selected increments across that range.

For example, referring to FIG. 3, a temperature of the SSL apparatus 10 may be set (Block S10), a predetermined current may be applied to the LED string 20 (Block S15) and a predetermined shunt level, or duty cycle, may be applied to a group of controlled LEDs, such as LEDS and LED6 shown in Figure (Block S20).

The chromaticity of light output by the SSL apparatus 10, e.g., in (u',v') coordinates, may be measured by the colorimeter 210 (Block S25), and the measured chromaticity point may be stored by the PLC 220. In some embodiments, the intensity of the light output by the SSL apparatus, measured in lumens, may be measured at Block 25 in addition to or instead of the color point of light emitted by the SSL apparatus 10.

Next, operations proceed to block S30, where the PLC 220 determines if the chromaticity point has been measured at all shunt levels for the selected temperature and current. If not, the next shunt level is selected (Block S35) and set (Block S20), and the chromaticity is measured at the new shunt level (Block S25).

Once chromaticity measurements have been taken at all shunt levels for the selected temperature and current level, the shunt level is reset (Block S40), and the PLC 220 determines if the chromaticity point has been measured at all current levels for the selected temperature (Block S45). If not, the next current level is selected (Block S50) and set (Block S15), and the chromaticity is measured for all shunt levels at the new current level (Blocks S20 to S35).

Once chromaticity measurements have been taken at all shunt and current levels for the selected temperature, the current level is reset (Block S55), and the PLC 220 determines if the chromaticity point has been measured at all temperature levels (Block S60). If not, the next temperature level is selected (Block S65) and set (Block S10), and the chromaticity is measured for all shunt levels and current levels at the new temperature level (Blocks S15 to S65).

Once chromaticity points have been measured at all temperatures, shunt levels and current levels, a model of the chromaticity response of the SSL apparatus 10 to changes in temperature, current and shunt level can be constructed (Block S70).

The operations illustrated in FIG. 3 may be repeated for each aspect of operation that is controlled by a controller of the LEDs. For example, if the SSL device sets a color point by shunting current around a red LED (or group of red LEDs) and separately shunting current around a blue LED (or group of blue LEDs), then the result of controlling these different color LEDs can be measured separately by maintaining the shunt around the red LEDs constant while the measurement of the blue LEDs is performed, and vice versa. Such an associative property of the impact of the changes in blue and red light level is possible because blue LEDs primarily affect color point in the v' axis, while red LEDs primarily affect color point in the u' axis. Furthermore, very little, if any color shift is expected with varying current in a red or a blue LED.

If there is interaction between the variables controlled by the controller 10, then additional loop(s) may be incorporated into the operations of FIG. 3 to take these interactions into account. For example, if color point is set by shunting around two phosphor converted LEDs (such as a BSY LED and a BSR LED) then the color point at each current, temperature and shunt level of BSY LED may need to be measured at each current, temperature and shunt level of the BSR LED to fully characterize the interaction between current, temperature and shunt level of the reference set of LEDs.

Once the effects of changes in current, temperature and shunt level on color point and/or lumens of an SSL apparatus have been characterized, predictive models can be developed to allow tuning and operational control of the LEDs in the SSL apparatus 10. In particular embodiments, a Bézier surface can be constructed based on the variables of light output characteristic (such as color point (u', v') and/or intensity in lumens), temperature, current level and shunt level. These Bézier surfaces are then used as a model to control the operation of an SSL apparatus 10 having the same combination of LEDs as the reference set of LEDs.

A Bézier surface is a mathematical tool for modeling a multidimensional function using a finite number of control points. In particular, a number of control points are selected that define a surface in an M-dimensional space. The surface is defined by the control points in a manner similar to interpolation. However, although the surface is defined by the control points, the surface does not necessarily pass through the control points. Rather, the surface is deformed towards the control points, with the amount of deformation being constrained by the other control points.

A given Bézier surface of order (n, m) is defined by a set of (n+1)(m+1) control points $k_{i,j}$. A two-dimensional Bézier surface can be defined as a parametric surface where the position of a point p on the surface as a function of the parametric coordinates u, v is given by:

$$p(u, v) = \sum_{i=0}^{n} \sum_{j=0}^{m} B_i^n(u) B_j^m(v) k_{i,j}$$

where the Bézier function B is defined as $$B_i^n(u) = \binom{n}{i} u^i (1-u)^{n-1}$$

and $$\binom{n}{i} = \frac{n!}{i!(n-i)!}$$

is the binomial coefficient.

Figure 4:
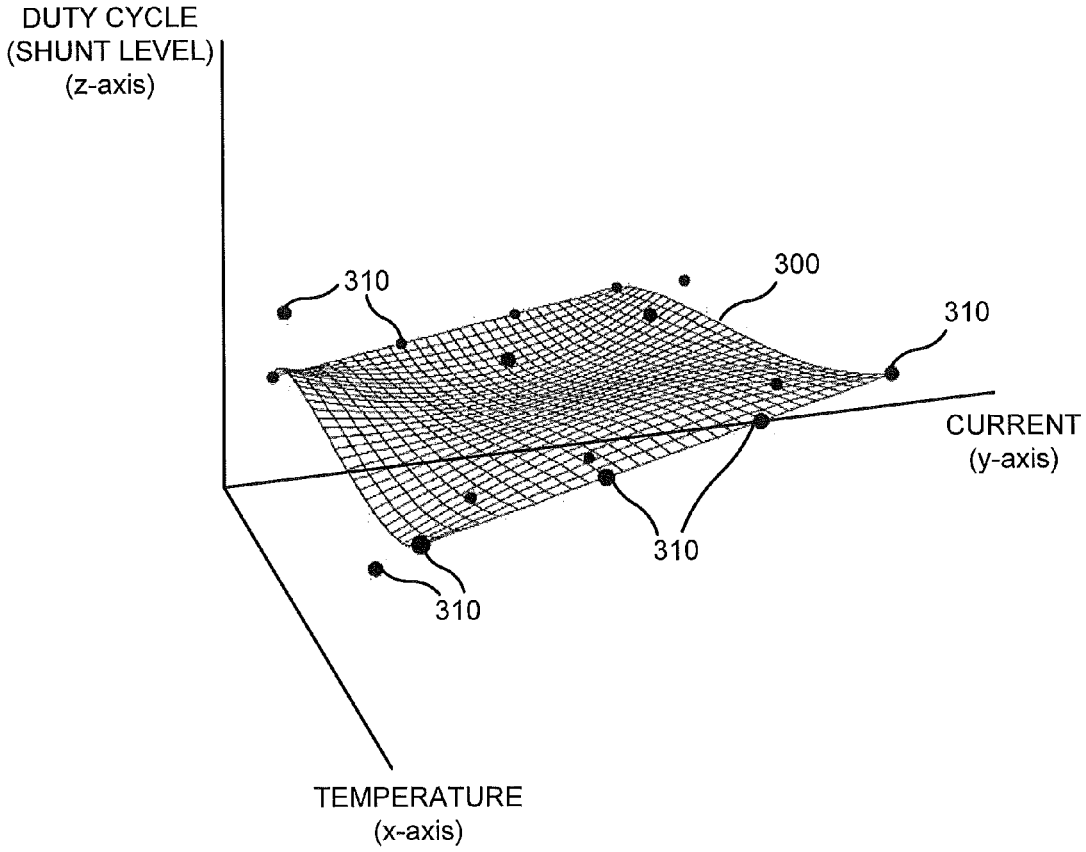
FIG. 4 illustrates a Bezier surface that may be used to characterize some aspects of a solid state light emitting apparatus according to some embodiments.

An example of a Bézier surface 300 is illustrated in FIG. 4. The Bézier surface 300 illustrated in FIG. 4 represents an LED shunt level (z-axis) plotted as a function of temperature (x-axis) and current (y-axis) of a solid state lighting apparatus. The surface 300 is defined by sixteen control points 310, which are points in the three-dimensional space represented by the x-, y- and z- axes shown in FIG. 4.

As can be seen in FIG. 4, the surface 300 is deformed towards the control points 310, but the control points 310 are not all on the surface 300. The Bézier surface 300 provides a mathematically convenient model for a multidimensional relationship, such as modeling LED shunt level as a function of temperature and current for a given output chromaticity, because the Bézier surface is completely characterized by a finite number of control points (e.g. sixteen).

Figure 5:
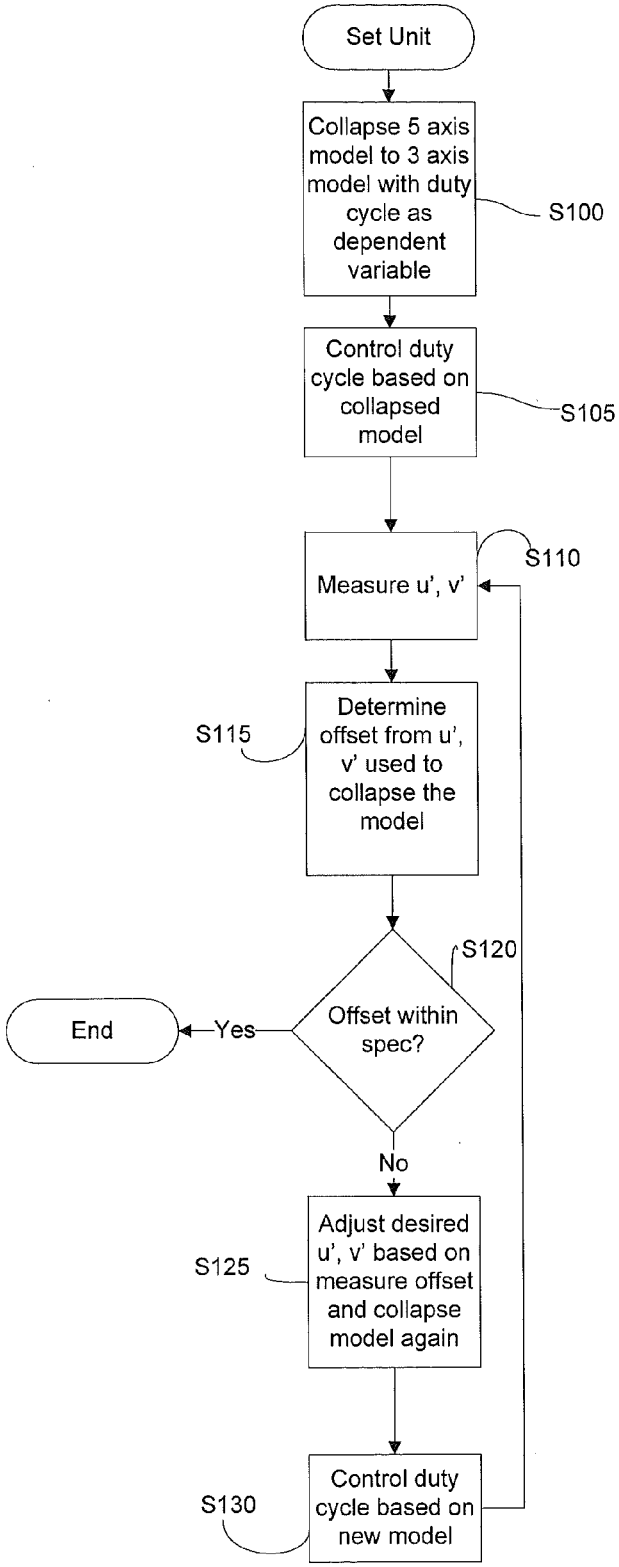
FIG. 5 illustrates methods of operating a solid state light emitting apparatus according to some embodiments.
Figure 6:
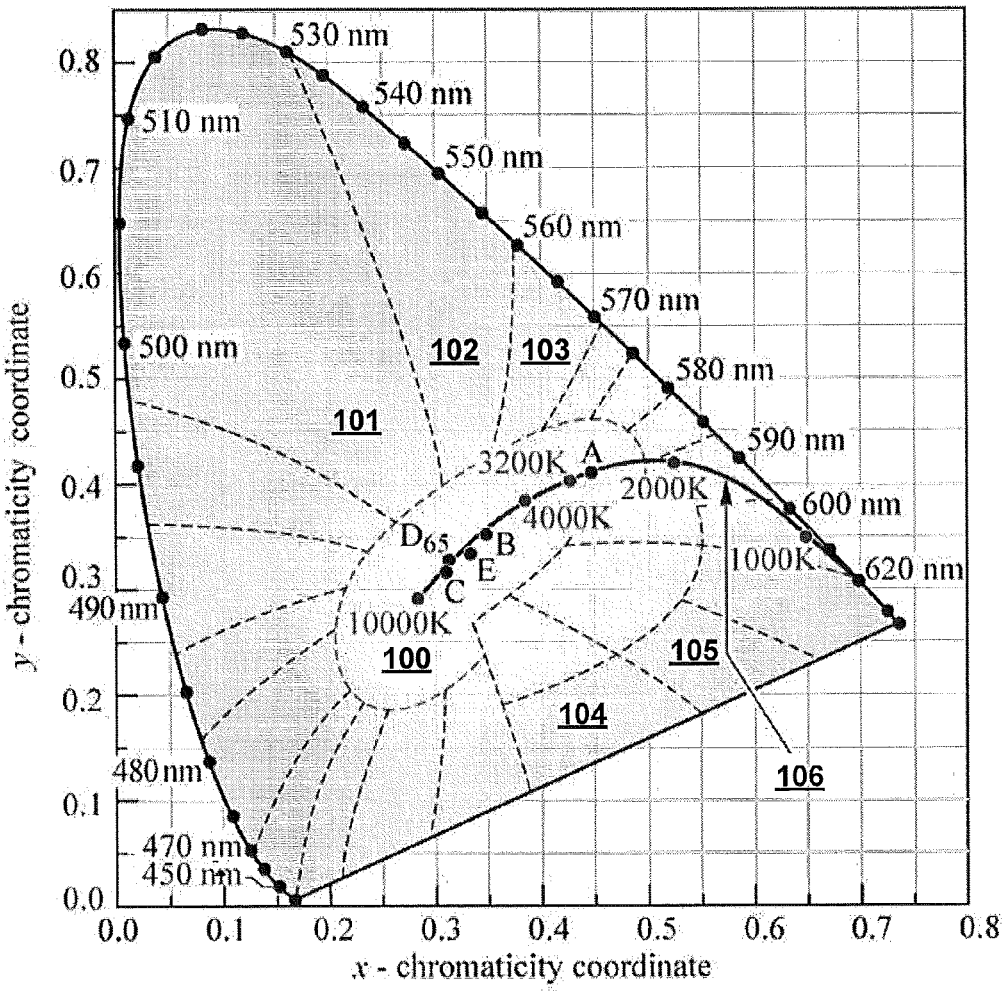
FIG. 6 illustrates a 1931 CIE chromaticity diagram.

The manufacture, calibration and/or operation of an SSL apparatus that has the same combination of LEDs as those in the reference set may be carried out as illustrated in FIG. 5.

As seen in FIG. 5, the five-axis models (u',v',T, I and S) are collapsed based on the desired color point (u',v') to three-axis models in which the shunt level is determined as a function of current (I) and temperature (T) (Block S100). That is, a three-axis model is constructed in which shunt level is dependent on current and temperature level for a given color point.

In some embodiments, a set of control points, which in some embodiments may include 16 control points, is established for the desired u',v' value, such that the shunt level of the a selected group of one or more controlled red LEDs required to achieve the desired (u',v') value is a dependent variable based on temperature and current level. A corresponding family of sets of 16 control points is established for the desired u',v' value such that the shunt level of a group of one or more controlled blue LEDs required to achieve the desired (u',v') value is a dependent variable based on temperature and current level. These control points are then used by the SSL apparatus 10 to control the light output of the SSL apparatus (Block S105), and a characteristic of the light output, such as color point and/or intensity, is measured (Block S110). The difference between the measured color point and the desired color point (i.e., the offset) is then measured (Block S115). If the measured color point is within the specification for the device (Block S120), then no additional operations need be performed and the SSL apparatus 10 utilizes the determined sets of control points to control the shunting of the red and blue LEDs to maintain color point with variations in temperature and current level. These control points may be permanently stored in the SSL apparatus 10 so as to control the operation of the SSL apparatus 10 in normal operation.

However, if the measured color point is out of specification for the apparatus 10, the offset between the measured color point and the desired color point is used to select a new target u',v' value (Block S125). The five variable models are again collapsed, the control points are set in the controller and the SSL apparatus is operated using the new control points (Block S130), and the light output again measured (Block S110). For example, if the u' value is 0.010 below the desired value, the desired u' value can be increased by 0.010 to compensate and new control points developed. These operations may be repeated until the color point of the SSL device is within specification or until a maximum number of attempts has been reached. Furthermore, the amount of adjustment allowed may be progressively reduced to avoid continuous overcompensation that may result in never achieving a color point within the desired specification.

Figure 7:
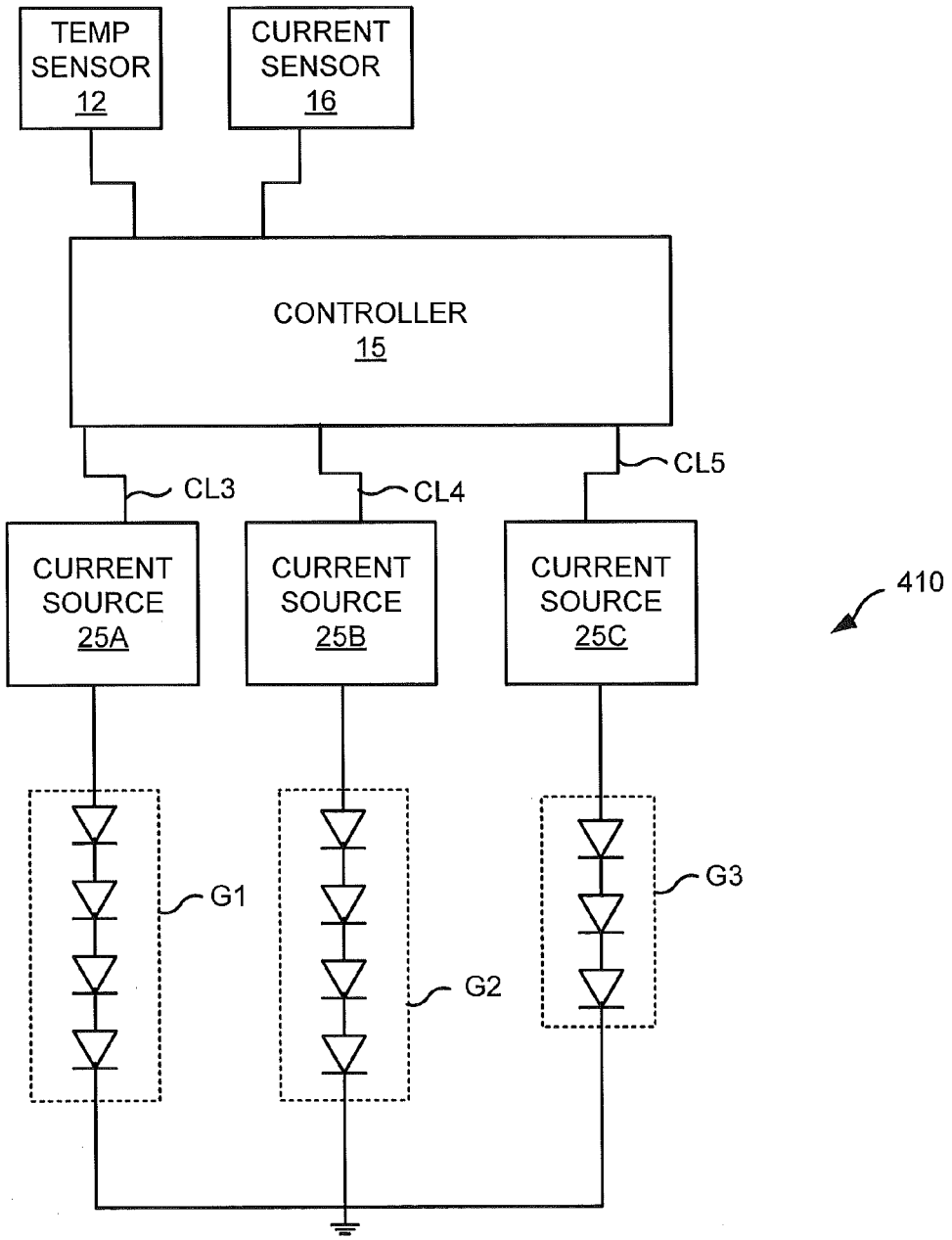
FIG. 7 is a schematic circuit diagram of portions of a solid state light emitting apparatus according to further embodiments.

FIG. 7 is a schematic circuit diagram of portions of a solid state light emitting apparatus 410 according to further embodiments. The solid state lighting apparatus 410 includes a controller 15 coupled via control lines CL3 to CL5 to a plurality of current sources 25A to 25C, each of which supplies current to a respective group G1 to G3 of series connected LEDs. A temperature sensor 12 supplies a temperature measurement of the solid state lighting apparatus 410 to the controller 15, while a current sensor 16 measures current through each of the groups of LEDs and supplies the current measurements to the controller 15.

The controller 15 may control the duty cycles of the groups of LEDs G1 to G3 by selectively activating/deactivating the current sources 25A to 25B. The groups of LEDs G1 to G3 may include the same or different types of LEDs. For example, in one embodiment, group G3 includes all BSY LEDs, while group G2 includes all blue LEDs and group G3 includes all red LEDs. The duty cycles of one or more groups of LEDs may be selected and controlled in accordance with the operations described above.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A method of controlling a solid state lighting apparatus, the method comprising:

providing a first model of a duty cycle of at least one light emitting device of the solid state lighting apparatus based on a temperature of the light emitting device and a level of current supplied to the light emitting device for a target chromaticity of light generated by the solid state lighting apparatus;

controlling the duty cycle of the at least one light emitting device in response to change in at least one of the temperature of the light emitting device and the level of current supplied to the light emitting device in accordance with the first model;

measuring an actual chromaticity of light generated by the solid state lighting apparatus in response to controlling the duty cycle of the at least one light emitting device in accordance with the first model;

comparing the measured chromaticity of light output by the solid state lighting apparatus to the target chromaticity for light output by the solid state lighting apparatus;

in response to a difference between the measured chromaticity and the target chromaticity, providing a second model of the duty cycle of the at least one light emitting device based on the temperature of the light emitting device and the level of current supplied to the light emitting device for an adjusted target chromaticity of light generated by the solid state lighting apparatus; and controlling the duty cycle of the at least one light emitting device in accordance with the second model.

2. The method of claim 1, wherein the first model of the duty cycle of the at least one light emitting device of the solid state lighting apparatus comprises a plurality of control points of a Bézier surface that relates the duty cycle of the at least one light emitting device to the temperature of the light emitting device and the level of current supplied to the light emitting device for the target chromaticity.

3. A method of controlling a solid state lighting apparatus, the method comprising:

providing a first model of an operating parameter of the solid state lighting apparatus based on at least one operating condition of the solid state lighting apparatus for a target light output characteristic of the solid state lighting apparatus;

controlling the operating parameter of the solid state lighting apparatus in response to a change in the at least one operating condition in accordance with the first model;

measuring the light output characteristic of the solid state lighting apparatus;

comparing the measured light output characteristic to an acceptable range of light output characteristics for the solid state lighting apparatus;

in response to a difference between the measured light output characteristic and the target light output characteristic, providing a second model of the operating parameter of the solid state lighting apparatus based on the at least one operating condition of the solid state lighting apparatus for an adjusted target light output characteristic of the solid state lighting apparatus; and controlling the operating parameter of the solid state lighting apparatus in response to a change in the at least one operating condition based on the second model.

4. The method of claim 3, wherein the operating parameter comprises a duty cycle of current supplied to at least one light emitting device in the solid state lighting apparatus.

5. The method of claim 3, wherein the at least one operating condition of the solid state lighting apparatus comprises a temperature of the solid state lighting apparatus.

6. The method of claim 3, wherein the at least one operating condition of the solid state lighting apparatus comprises a current supplied to at least one light emitting device in the solid state lighting apparatus.

7. The method of claim 3, wherein the at least one operating condition of the solid state lighting apparatus comprises a temperature of the solid state lighting apparatus and a current supplied to at least one light emitting device in the solid state lighting apparatus.

8. The method of claim 3, wherein the first model of the operating parameter of the solid state lighting apparatus comprises a plurality of control points of a Bézier surface that relates the operating parameter of the solid state lighting apparatus to the at least one operating condition of the solid state lighting apparatus for the target light output characteristic.

9. The method of claim 3, wherein the light output characteristic comprises a chromaticity point of light output by the solid state lighting apparatus.

10. The method of claim 3, wherein the light output characteristic comprises an intensity of light output by the solid state lighting apparatus.

11. The method of claim 3, wherein the solid state lighting apparatus comprises a first plurality of light emitting devices configured to emit light having a first chromaticity when energized and a second plurality of light emitting devices configured to emit light having a second chromaticity, different from the first chromaticity, when energized, wherein the operating parameter comprises a duty cycle of operation of the first plurality of light emitting devices.

12. A solid state lighting apparatus, comprising:

a first light emitting device configured to emit light having a first chromaticity when energized;

a second light emitting device configured to emit light having a second chromaticity, different from the first chromaticity; and a controller configured to control a current level supplied to the first light emitting device;

wherein the controller is configured to control the current level of the first light emitting device in response to a change in an operating condition of the solid state lighting apparatus in accordance with a model of the current level that relates the current level of the first light emitting device to the operating condition of the solid state lighting apparatus for a target light output characteristic of the solid state lighting apparatus;

wherein the model of the current level of the first light emitting device comprises control points of a Bézier surface that relates the current level of the first light emitting device to the operating condition of the solid state lighting apparatus for the target light output characteristic.

13. The apparatus of claim 12, wherein the first light emitting device is connected in series to a first current source and the second light emitting device is connected in series to a second current source, the apparatus further comprising a controller coupled to the first current source and configured to selectively activate and deactivate the first current source in accordance with the current level of the first light emitting device.

14. The apparatus of claim 12, wherein at least one of the first light emitting device and/or the second light emitting device comprises a plurality of light emitting elements.

15. The apparatus of claim 12, wherein the operating condition of the solid state lighting apparatus comprises a temperature of the solid state lighting apparatus and/or a current supplied to at least one light emitting device in the solid state lighting apparatus.

16. The apparatus of claim 12, wherein the current level of the first light emitting device comprises a duty cycle of the first light emitting device.

17. The apparatus of claim 12, wherein the light output characteristic comprises a chromaticity point of light output by the solid state lighting apparatus.

18. The apparatus of claim 12, wherein the light output characteristic comprises an intensity of light output by the solid state lighting apparatus.

19. The apparatus of claim 12, wherein the first light emitting device and the second light emitting device are connected in a series string, the apparatus further comprising a bypass circuit configured to selectively bypass the first light emitting device and a controller coupled to the bypass circuit and configured to control operation of the bypass circuit.

* * * * *